United States Patent [19]

Mercer

[11] Patent Number: 4,530,622

[45] Date of Patent: Jul. 23, 1985

[54] RETAINING FILL IN A GEOTECHNICAL STRUCTURE

[75] Inventor: Frank B. Mercer, Blackburn, England

[73] Assignee: P.L.G. Research Limited, Blackburn, England

[21] Appl. No.: 452,816

[22] Filed: Dec. 23, 1982

[51] Int. Cl.[3] ..... E02D 29/02

[52] U.S. Cl. ..... 405/258; 405/284

[58] Field of Search ..... 405/15, 16, 32, 258, 405/284

[56] References Cited

U.S. PATENT DOCUMENTS

| | | | |
|---|---|---|---|
| 3,670,504 | 6/1972 | Hayes et al. | 405/32 |
| 4,341,491 | 7/1982 | Neumann | 405/258 |
| 4,394,924 | 7/1983 | Zaccheroni | 405/32 X |

FOREIGN PATENT DOCUMENTS

| | | | |
|---|---|---|---|
| 1588415 | 4/1981 | United Kingdom | 405/284 |
| 2073281 | 10/1981 | United Kingdom | 405/284 |

*Primary Examiner*—David H. Corbin

*Attorney, Agent, or Firm*—Holman & Stern

[57] ABSTRACT

Plastics material mesh which has spaced, longitudinal, oriented strands is used to form a retainer construction for retaining fill in a geotechnical structure. Triangular compartments are formed by having a number of parallel elongate portions of the mesh and interconnecting them by zig-zag portions, each zig-zag portion thus being mainly contained between the two respective elongate portions, and being joined to the adjacent zig-zag portion at respective corners of the compartments. The connections are made by transversely bending the strands of one portion to form loops which project out the opposite side of the other portion, and passing a connecting member through the loops to prevent the loops being pulled back.

16 Claims, 7 Drawing Figures

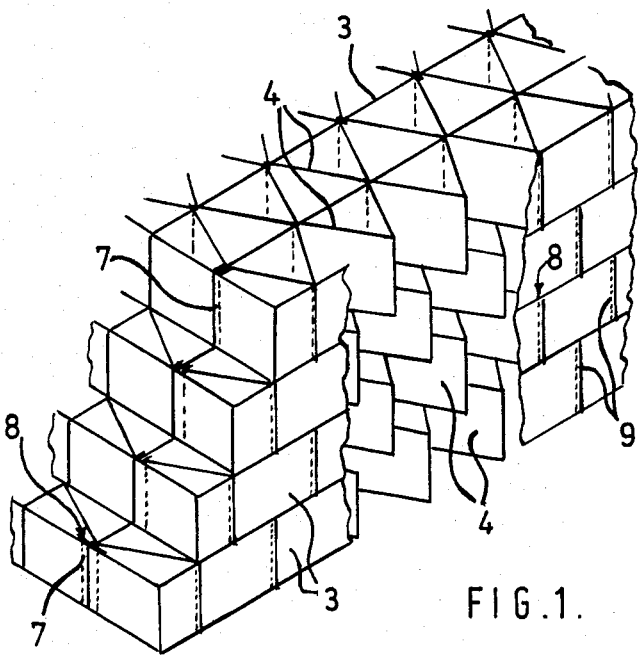
FIG. 1.
FIG. 2.
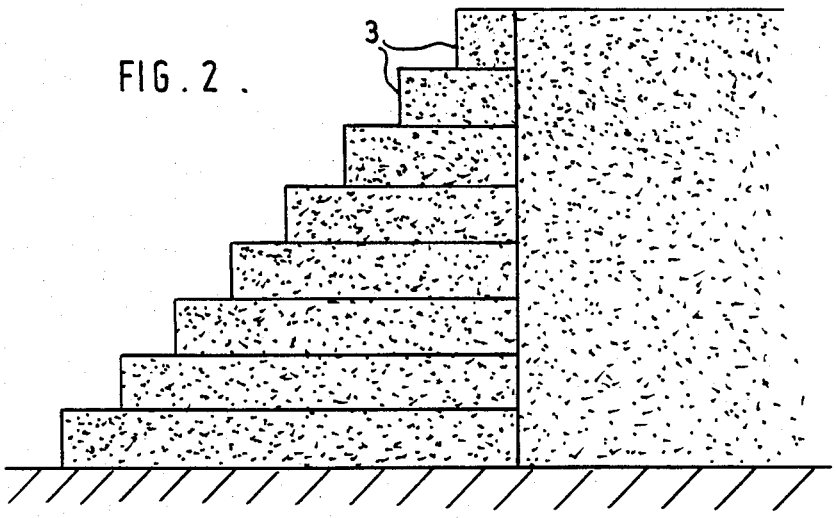

RETAINING FILL IN A GEOTECHNICAL STRUCTURE

BACKGROUND OF THE INVENTION

The present invention relates to a retainer construction for retaining fill in a geotechnical structure. The geotechnical structure may be any suitable structure, such as an embankment, a cutting side, a marine wall such as a quay, the side of an artificial island, a dam, a storage bunker, a mine dump, an unstable slope in a mountainous area, or a wall to contain explosions.

In some of these applications, it is known to use gabions or mattresses, which are generally thought of as being containers with wire or plastics material mesh sides containing stones or rocks. However, the retainer construction of the present invention need not be closed on all sides and need not have a top or bottom closure, and furthermore, the constructions can be of any suitable size, depending upon availability of materials.

THE INVENTION

In accordance with one aspect of the invention, there is provided a retainer construction for retaining fill in a geotechnical structure, comprising: providing at least one length of plastics material mesh which has transversely-spaced, longitudinally-extending, orientated strands; and forming at least one compartment by bending the mesh transversely and connecting two portions of the mesh together by transversely bending the strands of one portion to form loops, inserting the loops between the strands of the other portion so that the loops project out the opposite side of the latter portion, and passing a connecting member through the loops on the opposite side to prevent the loops being pulled back.

According to a second aspect of the invention, there is provided a method of forming a multi-compartment retainer construction for retaining fill in a geotechnical structure, comprising: providing a length of plastics material mesh which has transversely-spaced longitudinally-extending, orientated strands; and forming a plurality of polygonal compartments by bending the mesh transversely and connecting respective portions of the mesh together at corners of compartments, one portion of mesh forming at least two adjacent sides of a compartment and, at the corner where the two sides meet, the portion being connected to a second portion which also forms at least two adjacent sides of a compartment which meet at that corner.

According to a third aspect of the invention, there is provided a method of forming a multi-compartment retainer construction for retaining fill in a geotechnical structure, comprising: providing at least one length of plastics material mesh which has transversely-spaced longitudinally-extending, orientated strands; and forming a plurality of triangular compartments by placing at least two elongate portions of the mesh in spaced, generally parallel planes, and interconnecting the elongate portions by a zig-zag shaped portion which is connected to the elongate portions alternately at the bends of the zig-zag.

According to a fourth aspect of the invention, there is provided a method of forming a multi-compartment retainer construction for retaining fill in a geotechnical structure, comprising: providing at least one length of plastics material mesh which has transversely-spaced, longitudinally-extending, orientated strands; and forming a plurality of compartments by placing at least three elongate portions of the mesh in spaced, generally parallel planes, and connecting the elongate portions together by further, interconnecting portions of the mesh, separate portions of mesh being between different pairs of elongate portions and the interconnecting portion only projecting through the respective elongate portion, if at all, sufficient to make connection between the interconnecting portions and the elongate portions.

The invention extends to retainer constructions formed by any of the methods of the invention.

A particularly suitable mesh for use in the invention is that disclosed in British Patent Specification No. 2 035 191 B or 2 073 090 B. For some applications, the mesh may have been stretched in only one direction (No. 2 073 090 B), and this normally provides greater vertical stiffness; for other applications, the mesh may have been stretched in two directions at right angles (No. 2 035 191 B). Various definitions are given in the patent specifications referred to above, and, where appropriate, they also apply to the present specification.

It is understood by the term "bend transversely" that the bend is such that the bend line or zone extends transversely. The bend zone is referred to because the bend need not necessarily be along a sharp fold line but could be in the form of a curving round of the material.

The use of the connecting member to prevent the loops being pulled back, provides a quick and simple way of joining the two portions. The join can be considerably stronger than joins using ring clips and enables the full tensile strength of the orientated strands to be exploited, being comparable in strength to joins formed by "weaving", i.e. threading the connecting member over and under alternate doubled strands with the two portions placed flat against each other. Particularly where there are three portions being joined together, the connecting method enables the line of force in one portion to continue right through the join, without disturbance. In a particular situation where the longitudinal orientated strands are the strongest part of the material, the material is held by the strongest parts, and the orientated strands can be cold bent without severe weakening.

The formation of the polygonal compartments by bending the mesh transversely and connecting the corners together as appropriate provides a multi-compartmented retainer construction in a simple manner. The container having the triangular compartments is particularly suitable as it is a simple form but nonetheless resists parallelogram distortion when filled, i.e. as seen in plan view, distortion of a rectangular-shaped construction into a parallelogram shape.

DESCRIPTION OF PREFERRED EMBODIMENTS

The invention will be further described, by way of example, with reference to the accompanying drawings, in which:

FIG. 1 is a schematic view of a retainer construction in accordance with the invention;

FIG. 2 is a vertical section showing a retainer construction similar to that of FIG. 1 in use in a geotechnical structure;

FIGS. 1 TO 4

Figure 3:
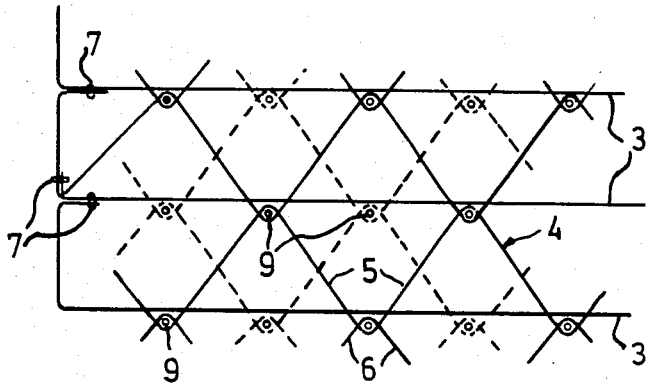
FIG. 3 is a schematic plan view, on a slightly larger scale, of part of the container construction of FIG. 1.
Figure 4:
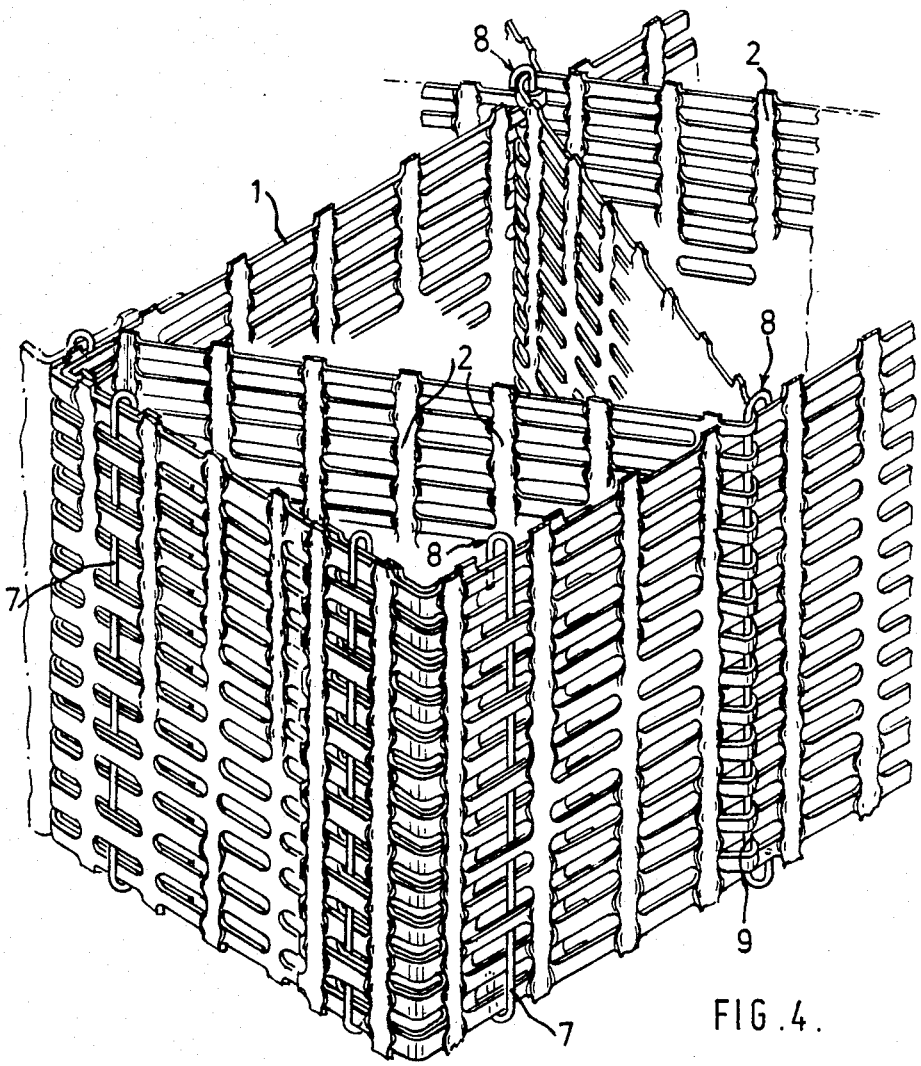
FIG. 4 is an isometric projection, on a larger scale, of part of the retainer construction of FIGS. 1 and 3.

The retainer construction of FIGS. 1 to 4 is formed using lengths of plastics material mesh which can be seen more easily in FIG. 4. The particular mesh shown in FIG. 4 has vertically-spaced, longitudinally-extending, orientated strands 1 which are interconnected by parts of the mesh which extend vertically and generally at right angles to the orientated strands 1, in the form of vertical bars 2 which are substantially less orientated than the orientated strands 1, but in the preferred construction have some orientation which interconnects aligned strands 1. There is a full description of methods of making such mesh in the British Patent Specifications referred to above. The particular mesh shown in FIG. 4 has been stretched in one direction during production, but it may have been stretched in two directions at right angles, and such stretching is also described in the British Patent Specifications referred to above. The mesh is cold bent transversely, all bends being made in the orientated strands 1 and none being made in the bars 2. The configuration of the mesh is apparent from FIG. 4 and from the full-line part of FIG. 3. It will be seen that vertical walls of a plurality of triangular compartments are formed by placing a number of elongate portions 3 of the mesh in spaced, generally parallel planes, and interconnecting the elongate portion 3 by respective zig-zag shaped portions 4, each of which is connected to the elongate portions 3 alternately at the bends of the zig-zag. It will be seen that the interconnecting zig-zag portions 4 only project through the respective elongate portions 3, if at all, sufficiently to make connections between the zig-zag portions 4 and the elongate portions 3. Looking at FIG. 3, it will be seen that one portion of the mesh (a zig-zag portion 4) forms two adjacent vertical walls 5 of one polygonal compartment, and, at the corner where the two vertical walls 5 meet, the first portion is connected to a second portion on the other side of an elongate portion 3, which second portion also forms two adjacent vertical walls 6 of a compartment which meet at said corner.

The connections are formed in two ways. Some of the connections 7 (see FIG. 4) are formed by weaving, threading a connecting rod 8 over and under alternate doubled strands 1 with the respective two portions placed flat against each other. Other connections 9 are made by transversely bending the strands 1 of one portion to form loops, inserting the loops between the strands 1 of the other portion so that they project out the opposite side of the latter portion, and passing a rod 8 through the loops on the opposite side to prevent the loops being pulled back. It will be seen that in order to avoid the necessity of distorting the orientated strands 1, it is preferred that the vertical spacing between adjacent orientated strands 1 should be at least equal to the width of the strands 1. The rod 8 can be supplied with a hook or return at one end; the hook or return at the other end can either be present when the rod is supplied or can be formed after making the connection.

In FIG. 3, the triangular compartments are roughly equilateral as this gives the best resistance with the least material.

If desired, the mesh can be provided pre-creased. When making up the container construction, a backing of for instance a textile material can be secured against the inner side of outer faces of the eventual geotechnical structure, depending upon the location of the structure and the infill material to be used.

To make a geotechnical structure, the retainer construction is erected so that the strands 1 are generally horizontal, and any suitable infilling is used, possible materials being earth, sand, clay, gravel, limestone, pulverised fuel ash, slag, silt or any bulk material.

As shown in FIG. 3, it is preferred that the elongate portions 3 of one layer are substantially directly above those of the layer below, and the bends of the zig-zag portion 4 of one layer are roughly halfway between the bends of the zig-zag portion 4 of the layer below (the zig-zag portions of the layer below are shown dashed in FIG. 3). This construction of "crossed triangles" increases vertical rigidity. The layers can be held together in any suitable way, for instance using ring clips.

It is not believed necessary to close the tops or the bottoms of the compartments, though this may be done if necessary, for instance using a mesh which has been stretched in two directions at right angles. More specifically, if desired, lengths of mesh can be placed in the structure in horizontal planes, to assist stabilisation.

In other constructions, for instance when making gabions or mattresses, there may be at least a base mesh closing the bottom of the compartment(s). If hooked connecting rods are used to make the connections, the hook at the bottom of the rod could be used to hook the base mesh to the remainder of the construction.

FIGS. 5 TO 7

Figure 5:
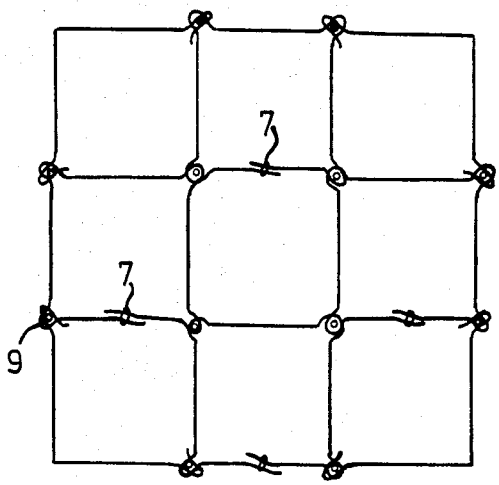
FIGS. 5 to 7 are schematic plan views of three further single-layer retainer constructions in accordance with the invention.
Figure 6:
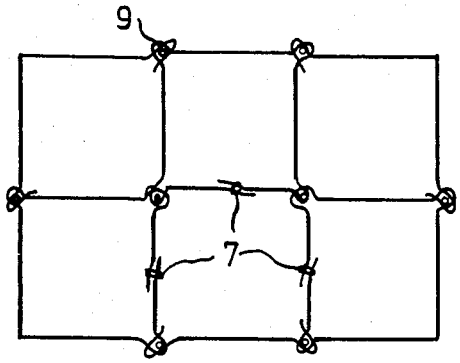
Figure 7:
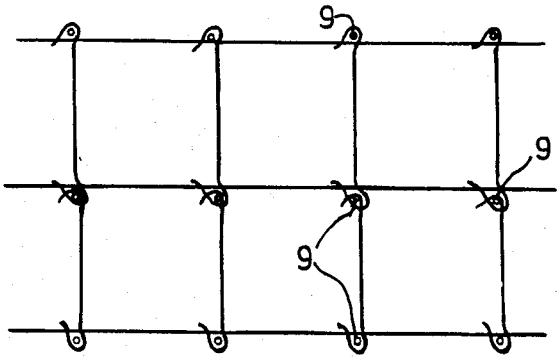

The retainer constructions of FIGS. 5 to 7 are apparent from the drawings, where the two types of connection 7,9 are indicated, generally as in FIG. 3. The construction shown in FIGS. 5 to 7 can be made up off site, and supplied in a fold-flat condition.

If desired, the connections 7 which are indicated in FIGS. 3 to 6 can be formed like the connections 9.

I claim:

1. A method of forming a retainer construction for retaining fill in a geotechnical structure, comprising:
   - providing plastics material mesh which has vertically-spaced, longitudinally-extending strands; and
   - forming substantially vertical walls of at least one compartment by bending the mesh tranversely and connecting two portions of the mesh together by tranversely bending the strands of one portion to form loops, inserting the loops between the strands of second portion so that the loops project out the opposite side of the second portion, and passing a rod means as connecting member through the loops on the opposite side to prevent the loops being pulled back.

2. The method of claim 1, wherein side-by-side of orientated strands are interconnected by integral parts of the mesh which extend substantially vertically and generally at right angles to the orientated strands, said integral parts being substantially less orientated than the orientated strands or being unorientated.

3. The method of claim 1, wherein the mesh comprises integral parts interconnecting side-by-side orientated strands, and all bends formed by said bending are formed in said strands.

4. A method of forming a multi-compartment retainer construction for retaining fill in a geotechnical structure, comprising:

providing a length of plastic material mesh which has vertically-spaced longitudinally-extending, orientated strands; and forming substantially vertical walls of a plurality of polygonal compartments by bending the mesh transversely and connecting respective portions of the mesh together at corners of the compartments, one portion of mesh forming at least two adjacent walls of a compartment and, at the corner where two said walls meet, the portion being connected to a second portion which also forms at least two adjacent walls of a compartment which latter walls meet at that corner.

5. A method of forming substantially vertical walls of a multi-compartment retainer construction for retaining fill in a geotechnical structure, comprising:

providing at least one length of plastics material mesh which has vertically-spaced longitudinally-extending, orientated strands; and forming a plurality of triangular compartments by placing at least two elongate portions of the mesh in spaced, generally parallel planes, and interconnecting the elongate portions by a zig-zag shaped portion which is connected to the elongate portions alternately at the bends of the zig-zag.

6. The method of claim 5, wherein there are at least three said portions in horizontally-spaced, generally parallel planes and at least two said zig-zag portions, the bends of one side of one zig-zag portion being immediately adjacent the bends on the nearer side of the other zig-zag portion.

7. The method of claim 5, in which the retainer construction is in a plurality of layers, the compartments being positioned so that the elongate portions of one layer are substantially directly above those of the layer below and the bends of the zig-zag shaped portion of one layer are roughly halfway between the bends of the zig-zag shaped portion of the layer below.

8. A method of forming a multi-compartment retainer construction for retaining fill in a geotechnical structure, comprising:

providing plastics material mesh which has vertically-spaced, longitudinally-extending, orientated strands; and forming substantially vertical walls of a plurality of compartments by placing at least three elongate portions of the mesh in horizontally-spaced, generally parallel planes, and connecting the elongate portions together by further, interconnecting portions of the mesh, separate portions of mesh being between different parts of elongate portions and the interconnecting portions only projecting through the respective elongate portion, if at all, sufficient to make the connection between the interconnecting portions and the elongate portions.

9. The method of claim 5, wherein the connection between said one portion and said second portion is formed by inserting loops, made by bending the mesh of said one portion transversely, between the strands of said second portion so that the loops project out the opposite side of said second portion, and passing a connecting member through the loops on said opposite side to prevent the loops being pulled back.

10. The method of claim 6, wherein the bends of the zig-zag shaped portion are connected to the two elongate portions by inserting loops, formed at the bends of the zig-zag portion, between the strands of the respective elongate portion so that the loops project out the opposite side of the elongate portion, and passing a connecting member through the loops on said opposite side to prevent the loops being pulled back.

11. The method of claim 8, wherein the interconnecting portions and the elongate portions are connected to each other by transversely bending the strands of the respective interconnecting portion to form loops, inserting the loops between the strands of the respective elongate portion so that the loops project out the opposite side of the elongate portion, and passing a connecting member through the loops on said opposite side to prevent the loops being pulled back.

12. The method of claim 1, wherein the retainer construction is erected so that said orientated strands are generally horizontal, and the retainer construction is infilled.

13. The method of claim 4, wherein the retainer construction is erected so that said orientated strands are generally horizontal, and the retainer construction is infilled.

14. The method of claim 5, wherein the retainer construction is erected so that said orientated strands are generally horizontal, and the retainer construction is infilled.

15. The method of claim 8, wherein the retainer construction is erected so that said orientated strands are generally horizontal, and the retainer construction is infilled.

16. A retainer construction for retaining fill in a geotechnical structure, comprising at least one length of plastics material mesh which has vertically-spaced, generally horizontally-extending, orientated strands, substantial vertical walls of at least one compartment having been formed in the retainer construction by bending the mesh transversely, two portions of the mesh being connected together by loops, formed by transversely bending the strands of one portion, passing between the strands of the other portion so that the loops project out the opposite side of said other portion, and being retained by a rod means as a connecting member passing through the loops on said opposite side and preventing the loops being pulled back.

* * * * *